US011571069B2

(12) United States Patent
Richmond et al.

(10) Patent No.: US 11,571,069 B2
(45) Date of Patent: Feb. 7, 2023

(54) BALCONY MOUNTED CHAIR AND INTEGRAL RAIL SOCKET

(71) Applicant: Hussey Seating Company, North Berwick, ME (US)

(72) Inventors: Paul-Jacob Michael Richmond, Biddeford, ME (US); Christian Harvie, Saco, ME (US)

(73) Assignee: Hussey Seating Company, North Berwick, ME (US)

( * ) Notice: Subject to any disclaimer, the term of this patent is extended or adjusted under 35 U.S.C. 154(b) by 0 days.

(21) Appl. No.: 17/445,435

(22) Filed: Aug. 19, 2021

(65) Prior Publication Data

US 2022/0053936 A1 Feb. 24, 2022

Related U.S. Application Data

(60) Provisional application No. 63/068,443, filed on Aug. 21, 2020.

(51) Int. Cl.
*A47C 1/126* (2006.01)
*A47C 1/121* (2006.01)

(52) U.S. Cl.
CPC ..... *A47C 1/126* (2013.01); *A47C 1/121* (2013.01)

(58) Field of Classification Search
CPC .. A47C 1/12; A47C 1/121; A47C 1/16; A47C 1/126; A47C 7/56; A47C 7/563
See application file for complete search history.

(56) References Cited

U.S. PATENT DOCUMENTS 6,293,621 B1 * 9/2001 Marsh ..... A47C 7/566 297/335
9,115,505 B2 * 8/2015 Magnus ..... A47C 1/12
2021/0068546 A1 * 3/2021 Paradis ..... A63J 25/00

FOREIGN PATENT DOCUMENTS

WO WO-0106894 A1 * 2/2001 ..... A47C 1/126

* cited by examiner

*Primary Examiner* — Milton Nelson, Jr.
(74) *Attorney, Agent, or Firm* — Preti Flaherty Beliveau & Pachios LLP

(57) ABSTRACT

A seating unit system is provided to mount seats to a nose of a balcony. The seating unit system includes a balcony mount beam secured to the nose of the balcony. The balcony mount beam includes a front plate and a return. The front plate has an upwards extension. The seating unit includes one or more seats. Each seat has a balcony mount stanchion and a front rail socket connected to the balcony mount stanchion. The balcony mount stanchion includes a hook feature and a balcony mount beam bracket. The hook feature attaches to the upwards extension of the front plate and the balcony mount beam bracket attaches to the return. The front rail socket is configured to receive a front rail.

14 Claims, 14 Drawing Sheets

Elevation of Extended Seating Unit

Elevation of Closed Seating Unit

Elevation of Extended Seating Unit

Elevation of Closed Seating Unit

Elevation of Extended Seating Unit

Elevation of Closed Seating Unit 9.00” thru 9.47”

10.50” thru 10.97”

12.00” thru 12.47”

13.00” thru 13.47”

BALCONY MOUNTED CHAIR AND INTEGRAL RAIL SOCKET

STATEMENT REGARDING FEDERALLY SPONSORED RESEARCH OR DEVELOPMENT

N/A

BACKGROUND OF THE INVENTION

Various embodiments relate generally to seating systems and devices and, more specifically, relate to folding and telescopic bleachers.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Folding and telescopic bleachers 102, 202, 302 are seating structures that can be retracted into a compact vertical stack of tiered seating to save floor space. These seating structures 102, 202, 302 often are configured to store completely underneath a balcony 101 or other seated platforms. In many scenarios there are tiers of more fixed seating beyond this transition location. In these transitioning cases, facilities often require there to be chairs at or on the balcony 101. When the telescopic seating structures 102, 202, 302 are stored underneath the balcony 101, a barrier rail 106 (also known as a front rail) is also used for safety to protect those on the balcony level.

There are two common approaches to this situation are shown in FIGS. 1-2.

The first solution that is commonly used is shown in FIG. 1. FIG. 1 shows standard telescopic seating 102 with removable skid-based chairs 104 in both extended (FIG. 1A) and closed (FIG. 1B) configurations. The last row of chairs 104 on the telescopic seating structure are removed in full prior to operation. This can be accomplished using floor mounted fixed chair assemblies 104 attached to plates (referred to as skid-based chairs). These skid chair assemblies 104 typically are attached to the telescopic seating structure 102 using machine screws.

FIG. 1 shows a telescopic seating structure 102 that utilizes this solution. If the last row has a large enough row space, a portable chair can be used in the same way. This solution may work satisfactorily for smaller seating areas, such as small theaters or K-12 gymnasiums, where the facilities will not be required to remove large quantities of chair assemblies. However, for large venues, such as collegiate gymnasiums or arenas, where large numbers of chairs are required to be moved, this solution is not practical. These removable chairs are heavy and can require large amounts of space to store when not in use.

A second solution that some venues consider can be seen in FIG. 2. FIG. 2 shows standard telescopic seating 202 with riser mounted fixed chairs 205 in both extended (FIG. 2A) and closed (FIG. 2B) configurations. It uses a fixed chair that is installed to a vertical surface of the building structure rather than on the last tier decking of the telescopic unit. This type of chair is commonly referred to as a riser mounted chair 205. This chair could be installed to the front face of the balcony 101 and have the front rail 106 installed behind that row of chairs. This will locate the rail 106 further into the first row of the fixed seating and could cause egress issues. Another issue with this solution is that the stanchion designed for fixed riser mounted seating 205 cannot easily be changed, therefore the seat height is determined by the location of its attachment to the riser. At transitions between the telescopic seating structure 202 and the fixed seating area, there can be a variation in the rise due to construction variations, and therefore the height of the riser. Anchoring limitations and the riser mounted stanchion design 205 can make the seat height in this row to be difficult to maintain. This solution can only be used in a few best-case situations.

Some venues may have the capability to work around these limitations, however, not all can. If a venue cannot utilize any of these solutions, they would have to compromise some aspect of their desired seating layouts.

What is needed is a seating structure that overcomes these limitations with the prior art.

BRIEF SUMMARY OF THE INVENTION

The below summary is merely representative and non-limiting.

The above problems are overcome, and other advantages may be realized, by the use of the embodiments.

In a first aspect, an embodiment provides a seating unit system to mount seats to a nose of a balcony. The seating unit system includes a balcony mount beam secured to the nose of the balcony. The balcony mount beam includes a front plate and a return. The front plate has an upwards extension. The seating unit also includes one or more seats. Each seat has a balcony mount stanchion and a front rail socket connected to the balcony mount stanchion. The balcony mount stanchion includes a hook feature and a balcony mount beam bracket. The hook feature attaches to the upwards extension of the front plate and the balcony mount beam bracket attaches to the return. The front rail socket is configured to receive a front rail.

In another aspect, an embodiment provides a seating unit configured to mount on a balcony mount beam of a balcony. The seating unit includes a balcony mount stanchion having a hook feature and a balcony mount beam bracket. The seating unit also includes a front rail socket connected to the balcony mount stanchion. The hook feature can attach to an upwards extension of the balcony mount beam and the balcony mount beam bracket can attach to a return of the balcony mount beam. The front rail socket is configured to receive a front rail when the balcony mount stanchions are rotated to the stored position.

BRIEF DESCRIPTION OF THE SEVERAL VIEWS OF THE DRAWINGS

Aspects of the described embodiments are more evident in the following description, when read in conjunction with the attached Figures.

FIG. 10 shows details of the beam that the balcony mount chair/rail solution is attached to.

DETAILED DESCRIPTION OF THE INVENTION

This patent application claims priority from U.S. Provisional Patent Application No. 63/068,443, filed Aug. 21, 2020, the disclosure of which is incorporated by reference herein in its entirety.

Figure 1A:
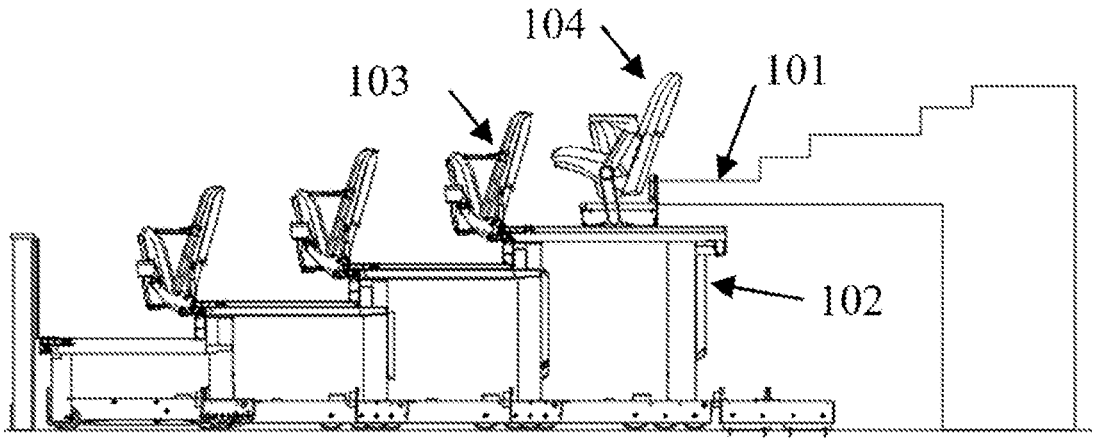
FIGS. 1A and 1B, collectively referred to as FIG. 1, show standard telescopic seating with removable skid based chairs, the seating rows extended (FIG. 1A) and closed (FIG. 1B).
Figure 1B:
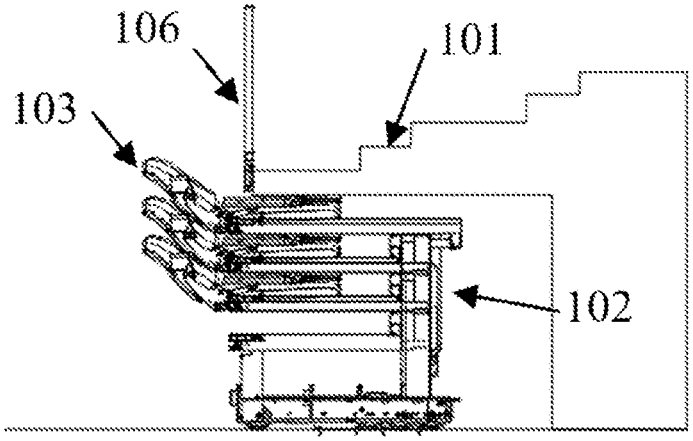
Figure 2A:
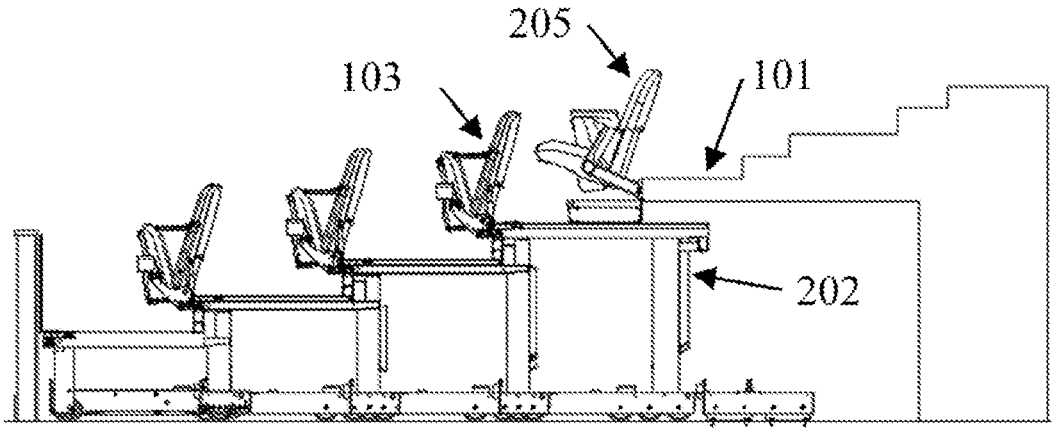
FIGS. 2A and 2B, collectively referred to as FIG. 2, show standard telescopic seating with riser mounted fixed chairs, the seating rows extended (FIG. 2A) and closed (FIG. 2B).
Figure 2B:
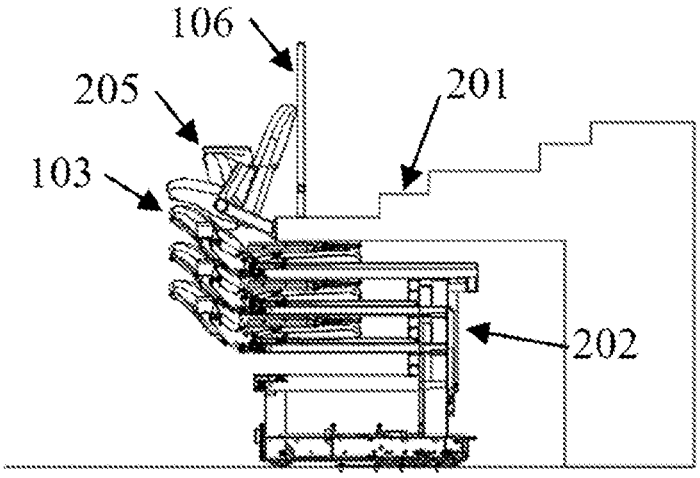
Figure 3A:
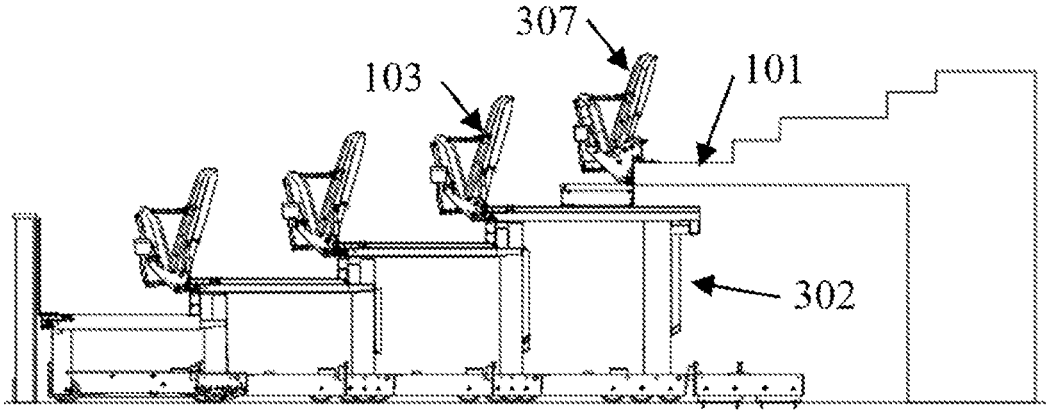
FIGS. 3A and 3B, collectively referred to as FIG. 3, show modified telescopic seating with a balcony mount chair installed on the balcony, with the seating rows extended (FIG. 3A) and closed (FIG. 3B).
Figure 3B:
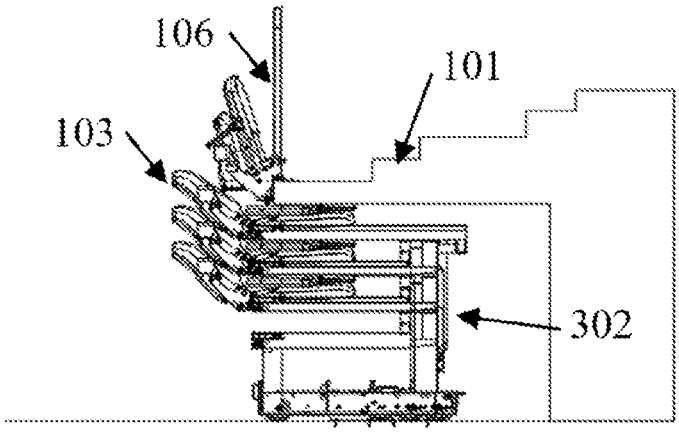
Figure 11:
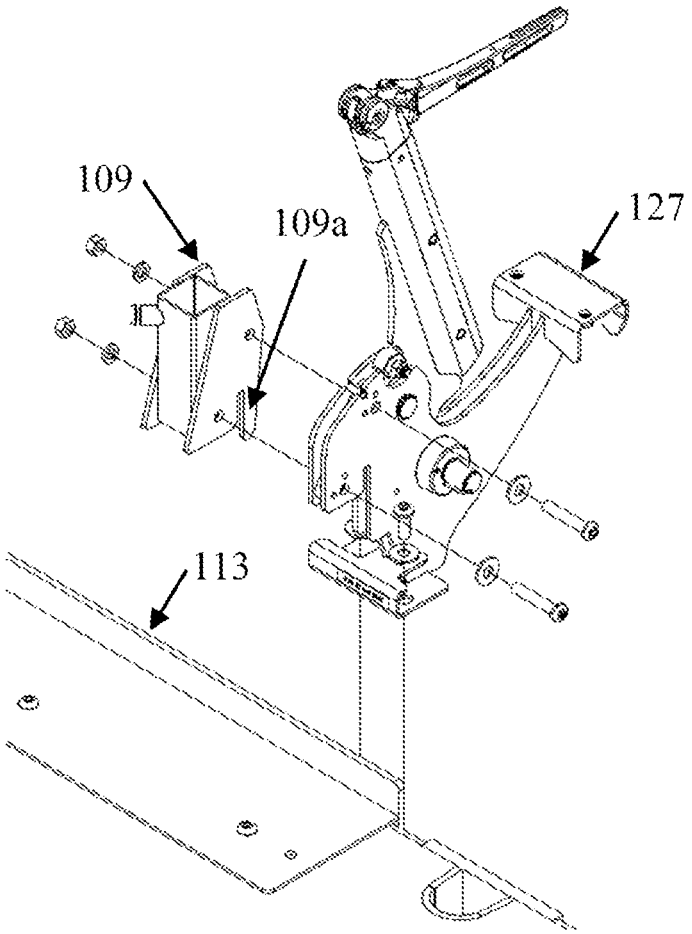
FIG. 11 shows an installation of the front rail socket and the balcony mount stanchion to the beam.

Various embodiments serve to provide a chair at the balcony 101 with an integrated front rail socket 109 (see FIG. 11). This design is versatile enough to allow for a wide range of transition heights and to allow for rails 106 to be installed without the need to remove chair assemblies. FIG. 3 shows a modified telescopic seating 302 with a balcony mount chair (or balcony mount nose mounted chair) 307 installed on the balcony 101 in an extended (FIG. 3A) and closed (FIG. 3B) configuration. FIG. 3 as an example of a section of seating that utilizes a balcony mounted chair 307 and integrated rail socket 109 solution.

Some embodiments include telescopic seating structures 302 that transition to a balcony 101 or require seating on a surface that is not suitable for conventional attachment methods such as heavily damaged surfaces. These systems are typically installed in school gymnasiums, theaters, arenas or stadiums, but not limited to these venues.

Figure 12:
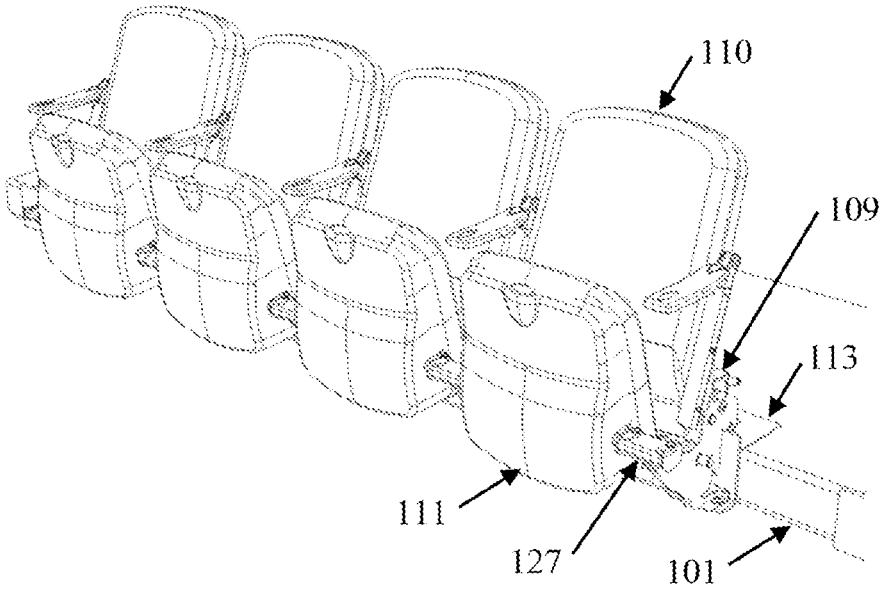
FIG. 12 shows an isometric view of a row of balcony mount nose mounted chairs in the used position.
Figure 13:
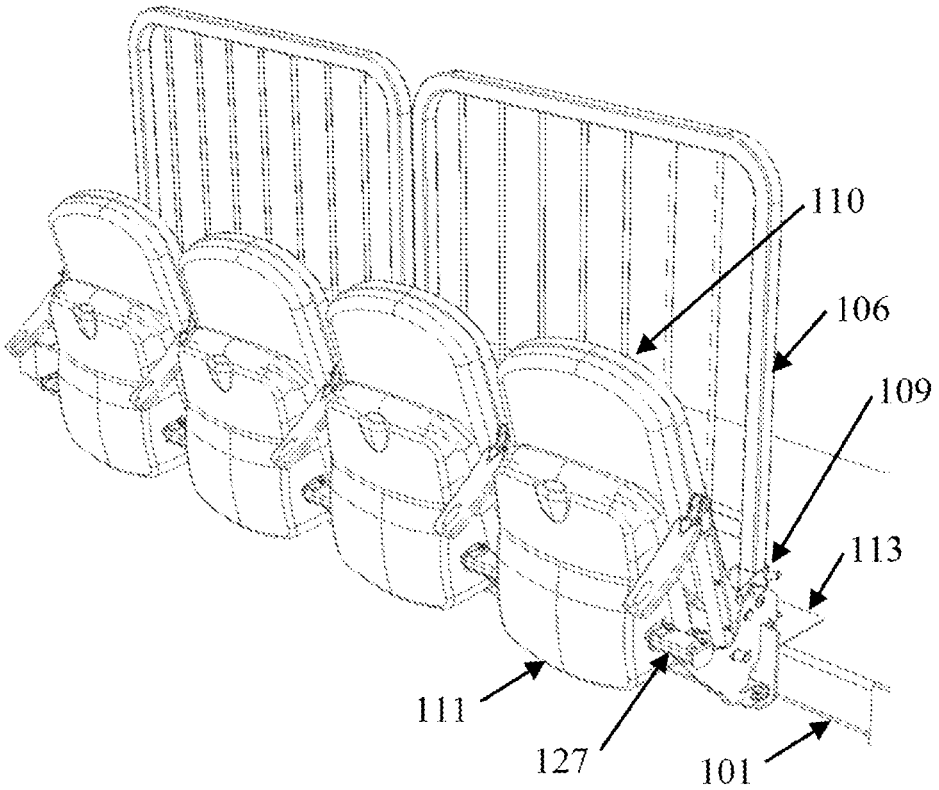
FIG. 13 shows an isometric view of a row of balcony mount nose mounted chairs in the stored position.
Figure 14A:
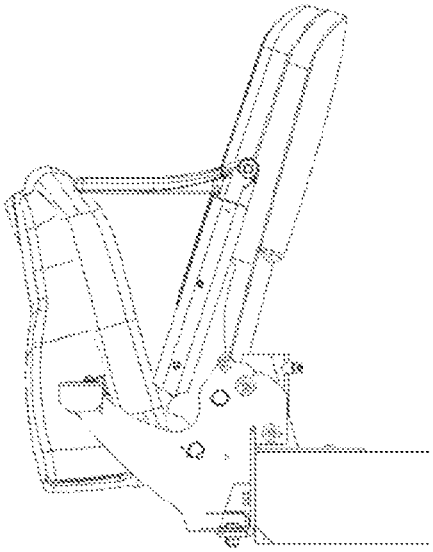
FIGS. 14A and 14B, collectively referred to as FIG. 14, show side views of a balcony mounted chair with an integrated front rail, in the stored (FIG. 14A) and used (FIG. 14B) used position.
Figure 14B:
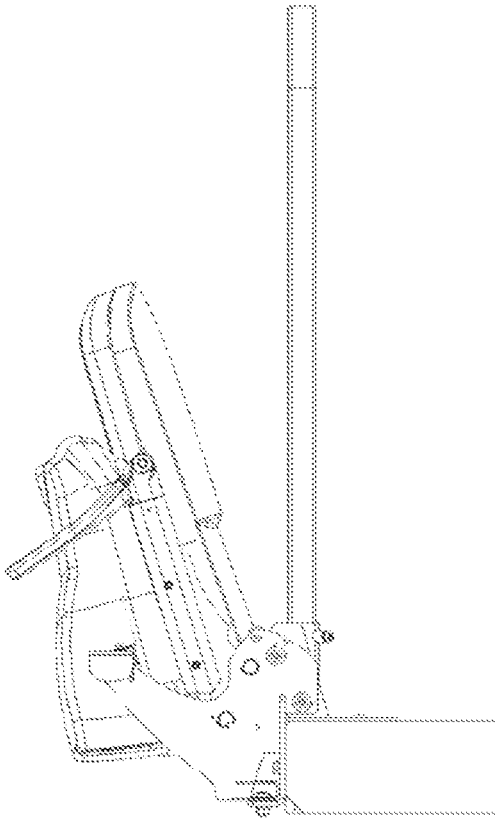
Figure 15A:
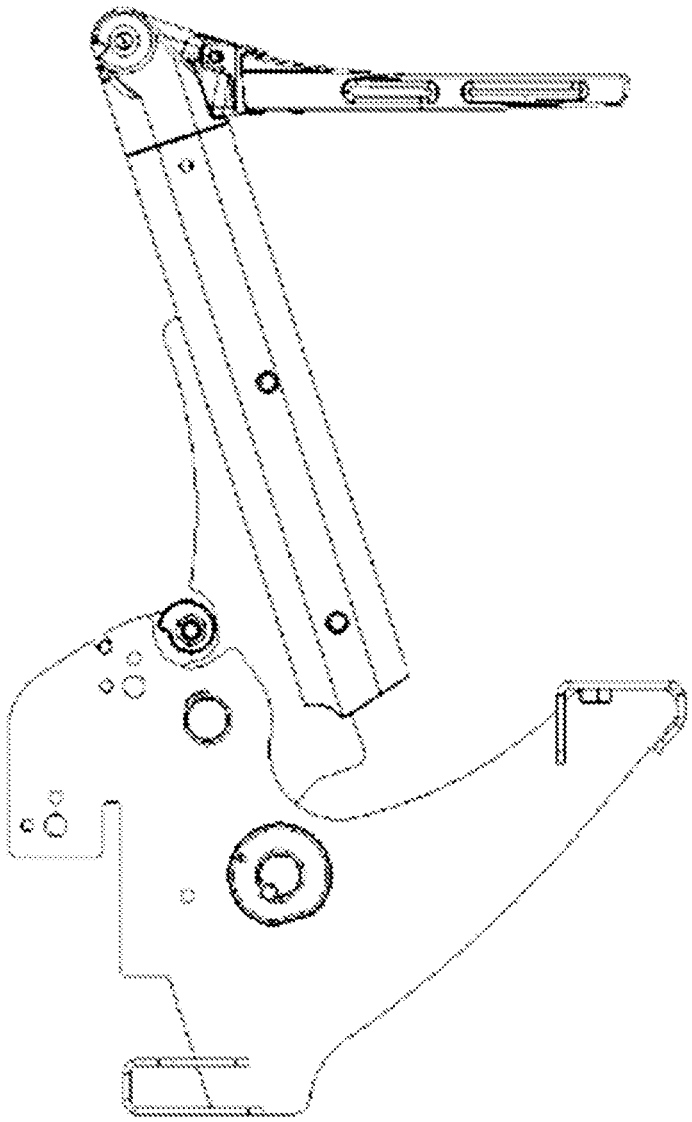
FIGS. 15A, 15B, 15C and 15D, collectively referred to as FIG. 15, show multiple rise ranges of the balcony mount stanchion.
Figure 15B:
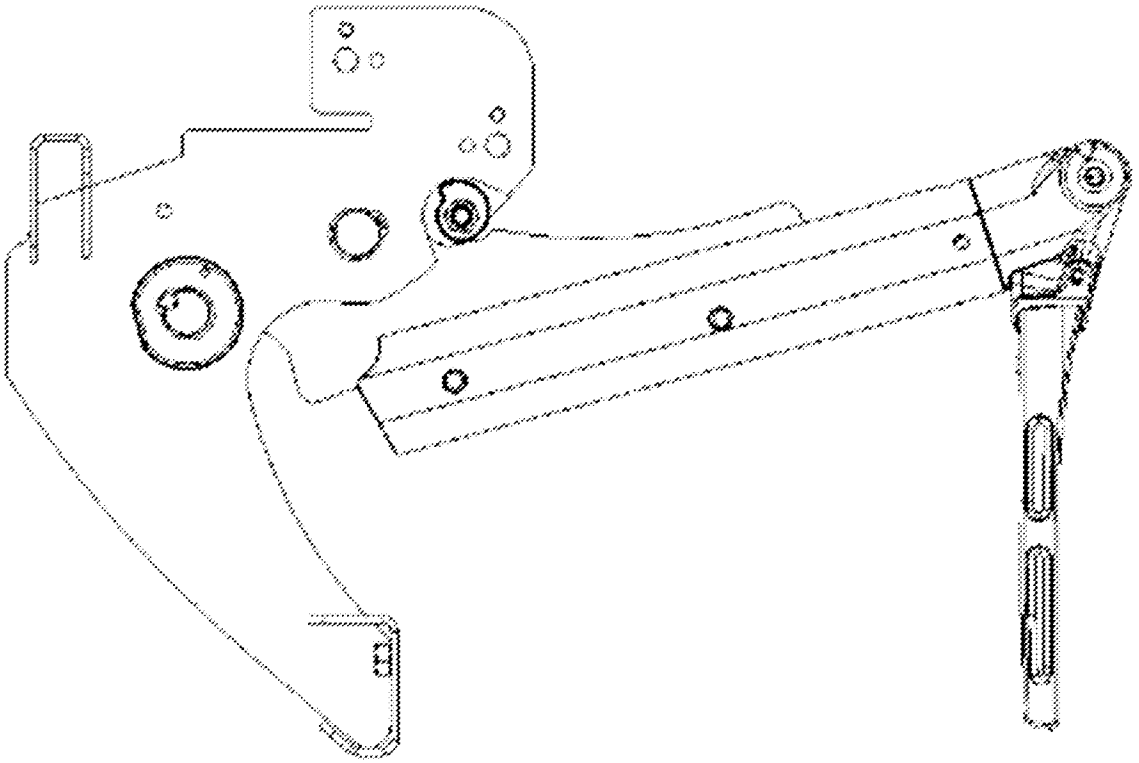
Figure 15C:
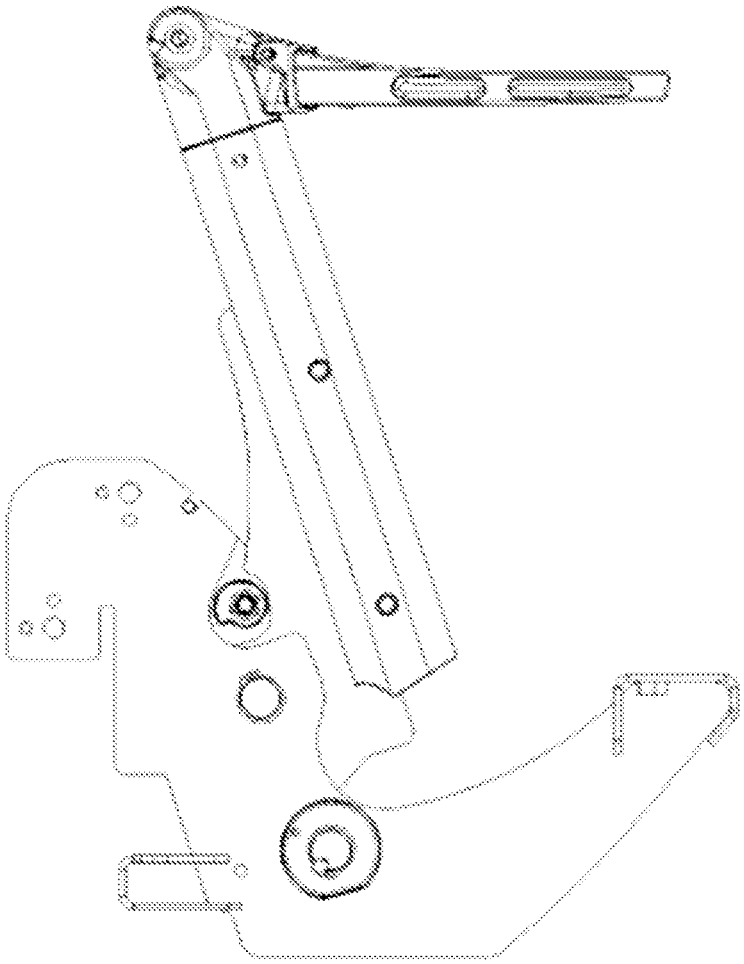
Figure 15D:
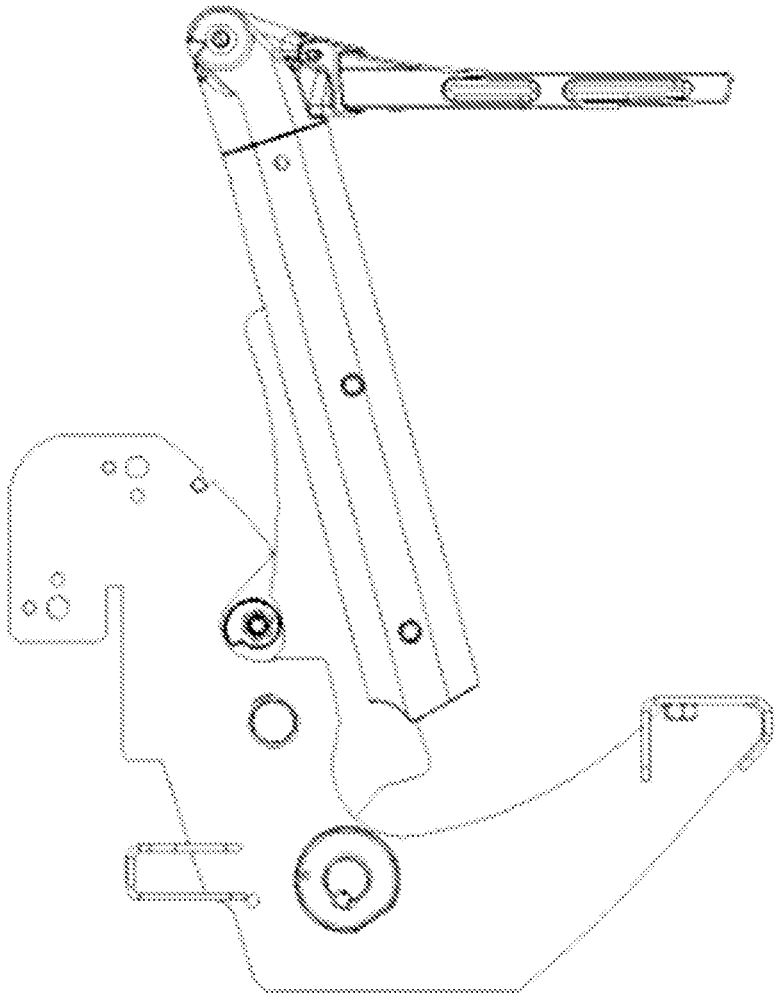

In one non-limiting embodiment, the balcony mounted chair with integrated rail socket solution is comprised of three main components: the balcony mount beam 113, the balcony mount stanchion 127, and the front rail socket 109. This solution can be fully seen in FIGS. 12-14. FIG. 12 shows an isometric view of a row of balcony mount nose mounted chairs 307 in the used position. FIG. 13 shows an isometric view of a row of balcony mount nose mounted chairs 307 in the stored position. FIG. 14 shows side views of a balcony mounted chair 307 with a front rail 106 removed and the seats ready for use (FIG. 14A) and with the front rail 106 in use (FIG. 14B). Each of these components have aspects of their design that ensure that any balcony construction, chair size, or transition can use this solution.

Figure 10:
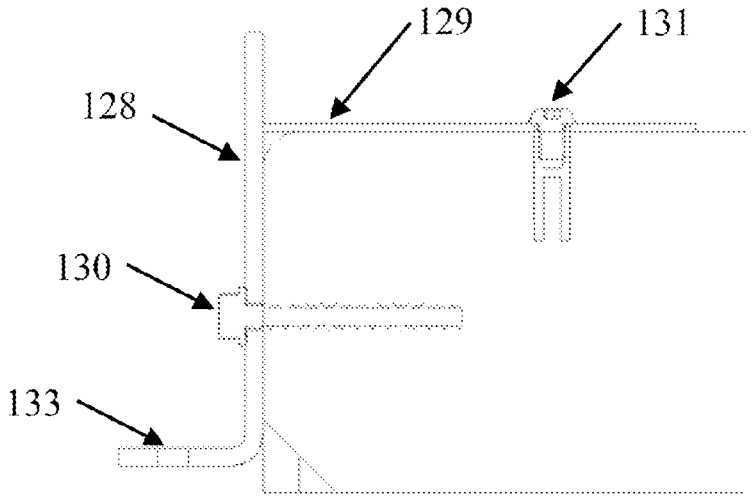

FIG. 10 shows details of the beam 113 design that the balcony mount chair/rail solution is attached to. The beam 113 is designed using a heavy gauge front plate 128 to take most of the live loads of the chair and an optional (application dependent) thinner top plate 129 to share the load and help prevent any twist from occurring in the beam 113 when under load. The design utilizes an attachment on the front 130 and top 131 faces of the balcony 101 to ensure that the connection between the beam 113 and the balcony 101 is rigid and produces the most stable feeling chair possible. There may be more attachment holes than are used to withstand the live loading by design. This allows for damaged areas of the balcony 101 or areas that cannot receive an attachment to be avoided during installation of the beam 113. A sectional view of the beam 113 can be seen in FIG. 10.

Figure 9:
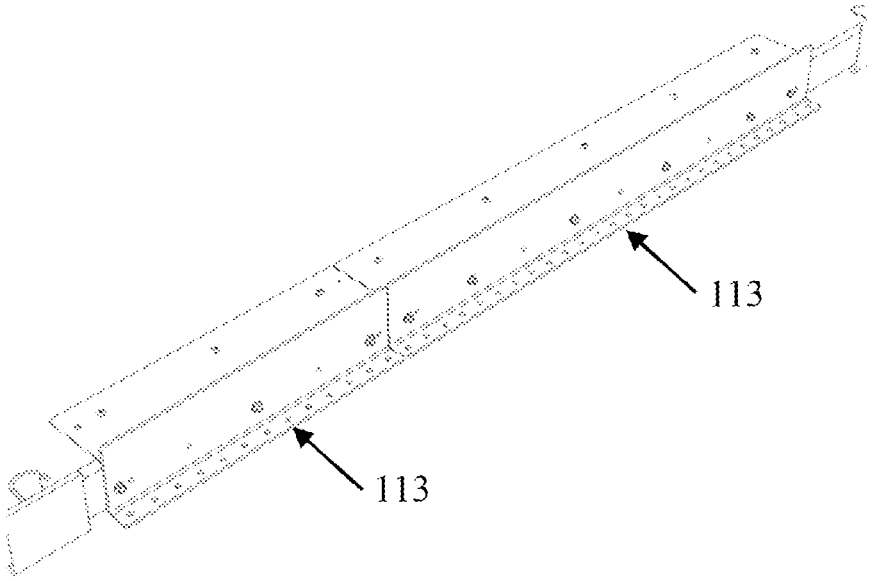
FIG. 9 shows a beam with attachments holes on the return of the heavy front plate.

The beam 113 is shown attached to concrete, however, in other embodiments, the beam 113 and attachment hardware can be altered to allow for attachment to other structures. It can also be seen in FIG. 10 that there is a return 133 at the bottom of the heavy front plate 128. This return has regular attachment holes in it, for example, every 2", for the chairs to be secured into the beam 113. An isometric view of this design can be seen in FIG. 9. FIG. 9 shows a beam 113 which is designed to have attachments holes every 2" on the return of the heavy front plate 128 to ensure that all seat size combinations can be installed on the same beam 113.

Figure 4A:
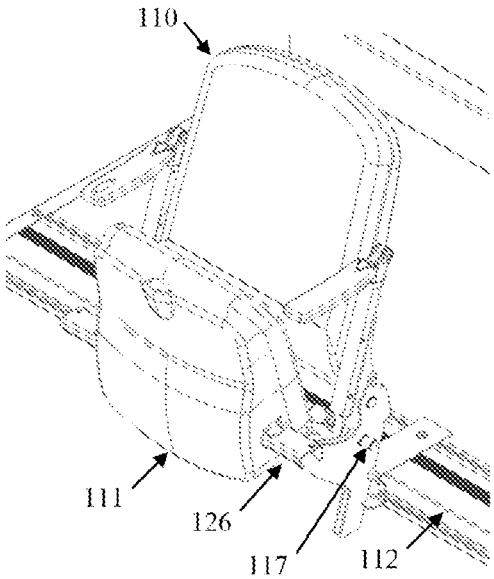
FIGS. 4A and 4B, collectively referred to as FIG. 4, show a low-rise range nose mounted chair in the used (FIG. 4A) and stored (FIG. 4B) position.
Figure 4B:
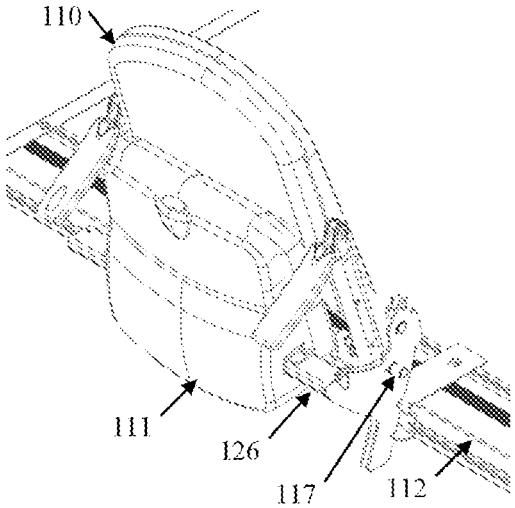

FIG. 4 shows a low-rise range nose mounted chair in the used (FIG. 4A) and stored (FIG. 4B) position. The balcony mount stanchion 127 uses an unlock mechanism and folding motion.

These chairs are typically constructed of three main parts: the back assembly 110, the seat assembly 111, and the stanchions 126 (commonly referred to as standards). For a nose mounted chair, the stanchions 126 are the components that will attach the chair to the platform 302 and dictate the seat height and back pitch of the chair. A stanchion is comprised of two main components: the bracket 115 and the stanchion tube 114. The bracket 115 is used to attach the stanchion 126 to the nose 112 or front beam of the platform 302 and to attach the seat 111 to the stanchion 126. The stanchion tube 114 attaches to the bracket 115 with a shaft 124 and provides an attachment location for the back assembly 110 and the armrest.

Figure 5A:
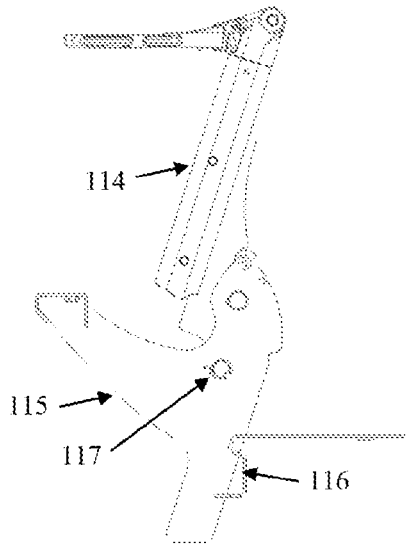
FIGS. 5A and 5B, collectively referred to as FIG. 5, show a low-rise range nose mount stanchion in the used (FIG. 5A) and stored (FIG. 5B) position, two stanchions paired together comprise the makeup of the nose mounted chair shown in FIG. 4.
Figure 5B:
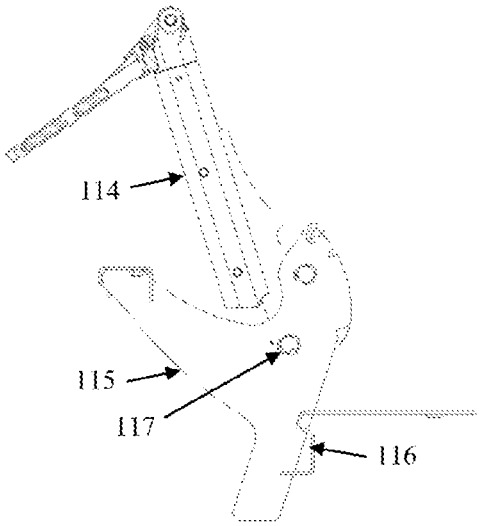
Figure 6A:
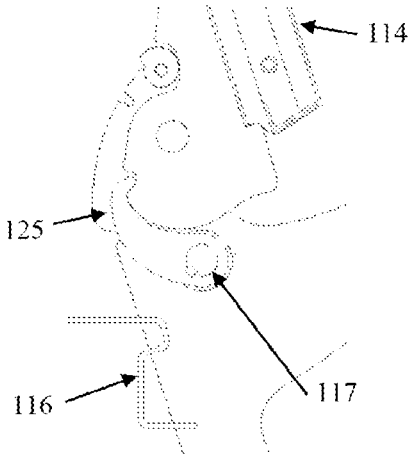
FIGS. 6A and 6B, collectively referred to as FIG. 6, show a cut-away view showing how a low-rise range nose mounted stanchion locks (FIG. 6A) and unlocks (FIG. 6B).
Figure 6B:
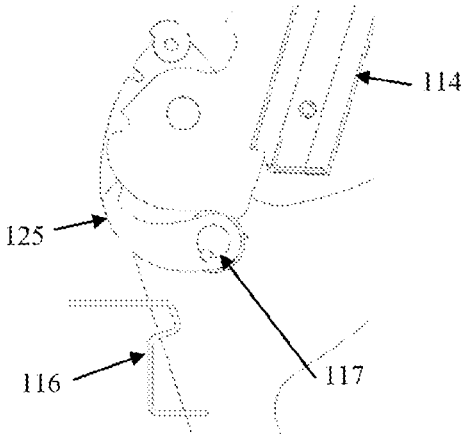

FIG. 5 shows a low-rise nose mount stanchion 126 in the used (FIG. 5A) and stored (FIG. 5B) configuration and FIG. 6 shows a cut view showing how a low-rise range nose mounted stanchion 126 unlocks. The nose mount stanchion latch 125 (see FIG. 6) can be released by rotating the unlock shaft 117 allowing the back assembly 110 and stanchion tube 114 to rotate forward so the chairs can nest together when stored.

Figure 7A:
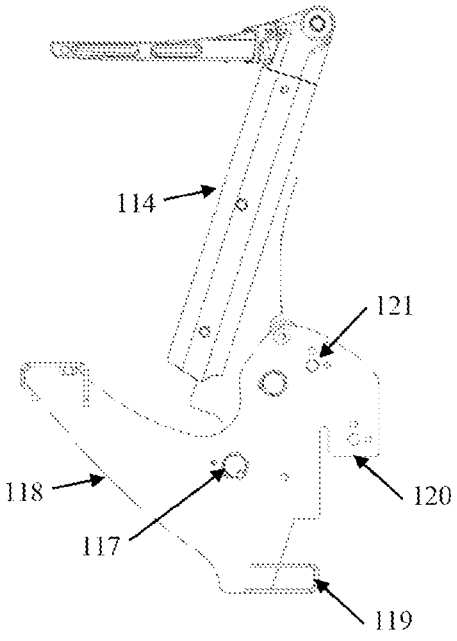
FIGS. 7A and 7B, collectively referred to as FIG. 7, show a balcony mount stanchion in the used (FIG. 7A) and stored (FIG. 7B) position.
Figure 7B:
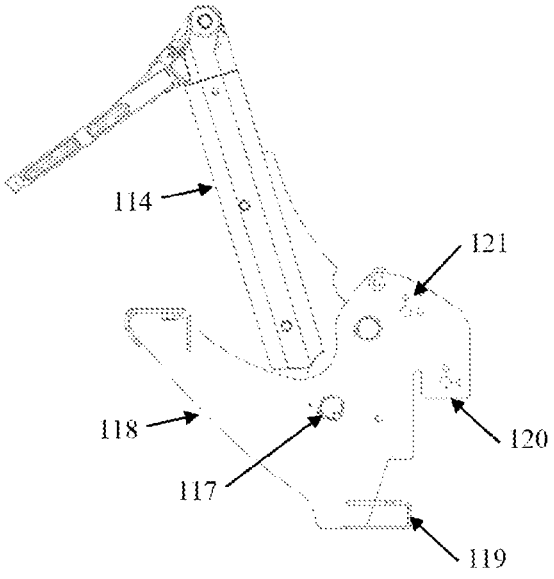
Figure 8:
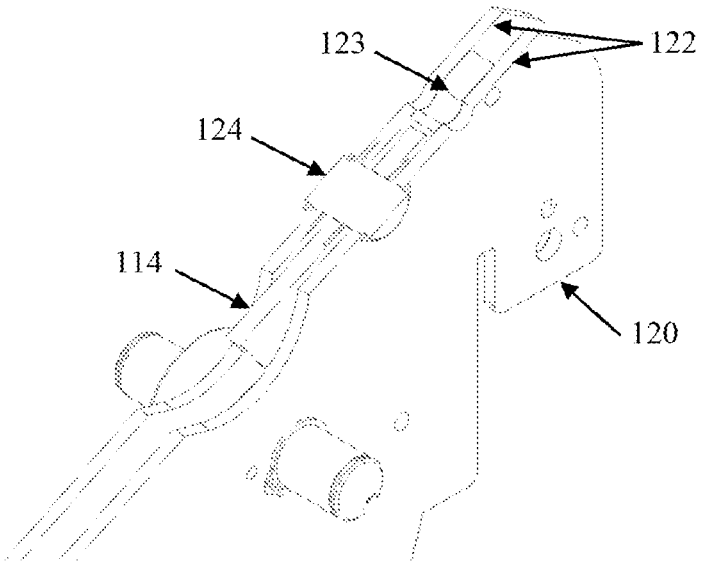
FIG. 8 shows a detailed cut view showing internal components of a balcony mount stanchion.

FIG. 7 shows a "balcony mount" stanchion 127, both in the used (FIG. 7A) and stored (FIG. 7B) position and FIG. 8 shows a detailed cut view showing internal components of a balcony mount stanchion 127. With the balcony mount stanchion 127, the rotation of the stanchion tube 114, the back pitch, and seat height are all mirrored after the low-rise nose mounted stanchion 126. However, with the balcony mounted stanchion 127 the side plates of the bracket 115 and nose mount bracket 116 allow for the stanchion 127 to be installed to a beam 113 that is attached to the balcony 101. The side plates 122 of the bracket 118 are designed to incorporate a hook feature 120. When attached to the beam 113, the hook feature 120 operates with an upward extension of the heavy front plate 128 to secure the chair 307. This is a main structural feature for the stanchion 127 and will take a majority of the live loads of the chair. This hook feature 120 can be seen in FIG. 7 and FIG. 8.

The balcony mount nose mounted chair 307 includes a balcony mount beam bracket 119 that is designed with four slots in it that are each spaced 1" from each other. This spacing along with the 2" spacing on the beam 113 allows for any chair size with 1" increments to be installed on the beam 113. This bracket 119 is located a very specific distance down from the hook feature 120 so that it can create a clamping force on the beam 113 when installed. This clamping force prevents against any movement of the stanchion 127 once it has been installed on the beam 113.

FIG. 11 shows an installation of the front rail socket 109 and the balcony mount stanchion 127 to the beam 113. The balcony mount stanchion 127 is designed with an integrated attachment location 121 for a front rail socket 109. The socket 109 bolts directly to the stanchion 127 through the spacers 123 with two machine screws and the socket has its own hook feature 109*a*. By having both an integrated attachment location 121 and a separate hook feature 109*a* on the socket 109, it is able to withstand the loading requirements of a full height front rail 106. The socket 109 is shaped in such a way that it doesn't interfere with any of the chair components, and it fits within the rake of the back assembly 110 of the balcony mount chair. This ensures that the socket 109 doesn't impede egress of the first row of fixed seating when the balcony mount chair 307 is in use.

The exact geometry of the bracket 118 will depend on the given rise that the chair is being installed on. Having the side plates 122 and beam bracket 119 modified to keep a consistent seat height at a transition can be applied to any rise transition. FIG. 15 shows multiple rise ranges of the balcony mount stanchion 127 that have been developed using this method.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A seating unit system, configured for mounting one or more seats and a front rail to a nose of a balcony, the seating unit system comprising:

a balcony mount beam, configured for being secured to the nose of the balcony, wherein the balcony mount beam includes a front plate having an upward extension and a return extending from a bottom region of the front plate, and at least one seat, wherein each of the at least one seat includes a balcony mount stanchion, each balcony mount stanchion configured for receiving a front rail socket coupled to the balcony mount stanchion, said front rail socket configured for receiving a front rail support, wherein the balcony mount stanchion includes a hook feature and a balcony mount beam bracket, wherein the hook feature is configured to attach the balcony mount stanchion to the upward extension of the front plate, and wherein the balcony mount beam bracket is configured to attach the balcony mount stanchion to the return of the balcony mount beam.

2. The seating unit system of claim 1, further comprising a front rail having at least two front rail supports, said at least two front rail supports configured for being inserted into at least two front rail sockets coupled to at least two balcony mount stanchions.

3. The seating unit system of claim 1, wherein the balcony mount beam further comprises a top plate, extending inwardly away from a vertical nose of said balcony, and configured to attach to an upward facing horizontal surface of the balcony.

4. The seating unit system of claim 1, wherein the return of the balcony mount beam comprises a plurality of attachment holes.

5. The seating unit system of claim 4, wherein the plurality of attachment holes are spaced 2 inches apart.

6. The seating unit system of claim 1, wherein each seat further comprises a back assembly and a seat assembly.

7. The seating unit system of claim 6, wherein the back assembly and the seat assembly are configured to move between a use configuration and a storage configuration.

8. The seating unit system of claim 7, wherein the back assembly is configured to rotate forwards when moving from the use configuration to the storage configuration.

9. The seating unit system of claim 7, wherein each seat further comprises a stanchion latch configured to lock the seat in the storage configuration.

10. A seating unit configured to mount on a balcony mount beam of a balcony, the seating unit comprising:

a balcony mount stanchion having a hook feature and a balcony mount beam bracket; and a front rail socket connected to the balcony mount stanchion, wherein the hook feature is configured to attach to an upwards extension of the balcony mount beam, wherein the balcony mount beam bracket is configured to attach to a return of the balcony mount beam, and wherein the front rail socket is configured to receive a front rail.

11. The seating unit of claim 10, further comprising a back assembly and a seat assembly.

12. The seating unit system of claim 11, wherein the back assembly and the seat assembly are configured to move between a use configuration and a storage configuration.

13. The seating unit system of claim 12, wherein the back assembly is configured to rotate forwards when moving from the use configuration to the storage configuration.

14. The seating unit system of claim 12, wherein each seat further comprises a stanchion latch configured to lock the seat in the storage configuration.

* * * * *